US012503926B2

(12) United States Patent
Al Marhoon et al.

(10) Patent No.: US 12,503,926 B2
(45) Date of Patent: Dec. 23, 2025

(54) LASER MILLING SYSTEM FOR CONCENTRIC CASING STRING CEMENT REPAIR

(71) Applicant: SAUDI ARABIAN OIL COMPANY, Dhahran (SA)

(72) Inventors: Zahrah Al Marhoon, Dhahran (SA); Amjad Alsharaawi, Dhahran (SA); Sameeh Batarseh, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 146 days.

(21) Appl. No.: 18/585,748

(22) Filed: Feb. 23, 2024

(65) Prior Publication Data

US 2025/0270890 A1 Aug. 28, 2025

(51) Int. Cl.

| | |
|---|---|
| ***E21B 43/34*** | (2006.01) |
| ***E21B 29/06*** | (2006.01) |
| ***E21B 29/10*** | (2006.01) |
| ***E21B 33/13*** | (2006.01) |

(52) U.S. Cl.
CPC ..... *E21B 29/10* (2013.01); *E21B 29/06* (2013.01); *E21B 33/13* (2013.01)

(58) Field of Classification Search
CPC ..... E21B 43/34; C09K 8/42
USPC ..... 166/277
See application file for complete search history.

(56) References Cited

U.S. PATENT DOCUMENTS

| | | | | |
|---|---|---|---|---|
| 11,041,354 | B2 * | 6/2021 | Pipchuk | E21B 36/04 |
| 2019/0178036 | A1 * | 6/2019 | Faircloth | B23K 26/146 |
| 2022/0018201 | A1 * | 1/2022 | Bouldin | E21B 37/00 |
| 2022/0290527 | A1 * | 9/2022 | Shafer | E21B 33/134 |

* cited by examiner

*Primary Examiner* — William D Hutton, Jr.
*Assistant Examiner* — Ashish K Varma
(74) *Attorney, Agent, or Firm* — Vorys, Sater, Seymour and Pease LLP

(57) ABSTRACT

A method includes setting a primary plug within a wellbore flowpath defined through a radially innermost casing string of a plurality of concentric casing strings, operating a laser milling tool within the wellbore flowpath to discharge a laser beam into the wellbore flowpath to thereby mill a window through the radially innermost casing string and radially outward towards a radially innermost cement column of a plurality of respective cement columns surrounding each of the concentric casing strings, discharging an abrasive fluid from an abrasive jetting tool into the wellbore flowpath and cleaning out the radially innermost cement column to expand the window radially, flowing a secondary plug material into the window and the wellbore flowpath above the primary plug, solidifying the secondary plug material to form a solidified secondary plug within the window, and drilling out the solidified secondary plug to restore the wellbore flowpath through the solidified secondary plug.

17 Claims, 9 Drawing Sheets

LASER MILLING SYSTEM FOR CONCENTRIC CASING STRING CEMENT REPAIR

FIELD OF THE DISCLOSURE

The present disclosure relates generally to concentric casing string cement repair and, more particularly, to methods and systems for laser milling of concentric casing strings for cement repair.

BACKGROUND OF THE DISCLOSURE

Oil and gas wellbores are commonly drilled in a series of progressively smaller casings until reaching a desired depth. A wellbore drilling operation may begin with drilling into a formation to a specified depth for a first casing string, also known as a first "casing depth". The first casing string may be run downhole to the first casing depth and cemented in place by pumping cement between the formation and the first casing string to form a first stage cement column. The operation may continue with drilling to a second casing depth and running a second casing string downhole through the first casing string. The second casing string may then be cemented in place with a second stage cement column formed by pumping cement upward between the second casing string and the formation and continuing upward through a "casing-casing annulus" defined between the first casing string and the second casing string. The operation may continue with subsequent drilling and cementing stages until reaching a desired wellbore depth.

Once the drilling is complete, a production tubing may be installed within the innermost casing string, and production operations may be initiated to recover oil and gas resources through the production tubing. During the production operations, cracks or imperfections within the cement columns may lead to leaks or failures within the cement columns. These leaks may lead to a sustained casing pressure behind one or more casing strings, which may lead to undesirable flow within one or more casing-casing annuli and negatively affect overall wellbore integrity.

To avoid costly workover operations on wellbores with sustained casing pressure, methods have been developed to correct leaks or failures downhole. These methods include deploying a perforation gun or other tool to form perforations through the casing strings and cement columns, and then inserting a resin mixture within the perforated area to seal the leaks. Since the perforation gun may utilize explosives or hazardous equipment, forming the perforations may result in damage to the surrounding area and weakening of the geology surrounding the wellbore. Further, other repair methods may employ mechanical means for sectional milling or perforating of the casing strings and cement columns that employ full drilling rigs, and may therefore be costly and time-consuming.

Accordingly, methods and systems are desired for reliably correcting leaks and failures within concentric casings without mechanical milling means or a drilling rig.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a method includes setting a primary plug within a wellbore flowpath defined through a radially innermost casing string of a plurality of concentric casing strings, operating a laser milling tool within the wellbore flowpath to discharge a laser beam into the wellbore flowpath to thereby mill a window through the radially innermost casing string and radially outward towards a radially innermost cement column of a plurality of respective cement columns surrounding each of the concentric casing strings. The method further includes discharging an abrasive fluid from an abrasive jetting tool into the wellbore flowpath and thereby cleaning out the radially innermost cement column to expand the window radially, flowing a secondary plug material into the window and the wellbore flowpath above the primary plug, solidifying the secondary plug material to form a solidified secondary plug within the window, and drilling out the solidified secondary plug to restore the wellbore flowpath through the solidified secondary plug.

In another embodiment, a wellbore repair system includes a plurality of concentric casing strings disposed within a wellbore, a plurality of cement columns disposed radially outward of each of the concentric casing strings, a window defined radially through at least a radially innermost casing string of the one or more of the concentric casing strings and a radially innermost cement column of the plurality of cement columns, wherein the window defines a first axial length through the radially innermost casing string and a second axial length through the radially innermost cement column, and wherein the second axial length is greater than the first axial length, a primary plug set within an interior of the radially innermost casing string below the window, and a solidified secondary plug filling the window above the primary plug.

In a further embodiment, a wellbore system includes a plurality of concentric casing strings disposed within a wellbore, a plurality of cement columns disposed radially outward of each of the concentric casing strings, a primary plug set within an interior of a radially innermost casing string of the plurality of concentric casing strings, a laser milled window defined in the radially innermost casing string and defining a first axial length, an abrasive jetting tool including a jetting head and one or more nozzles, couplable to the coiled tubing, and insertable within the flowpath of the wellbore to clean out cement from the radially innermost cement column to a second axial length greater than the first axial length by jetting an abrasive fluid behind the radially innermost casing string through the laser milled window, and a secondary plug material insertable into the window to generate a solidified secondary plug.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
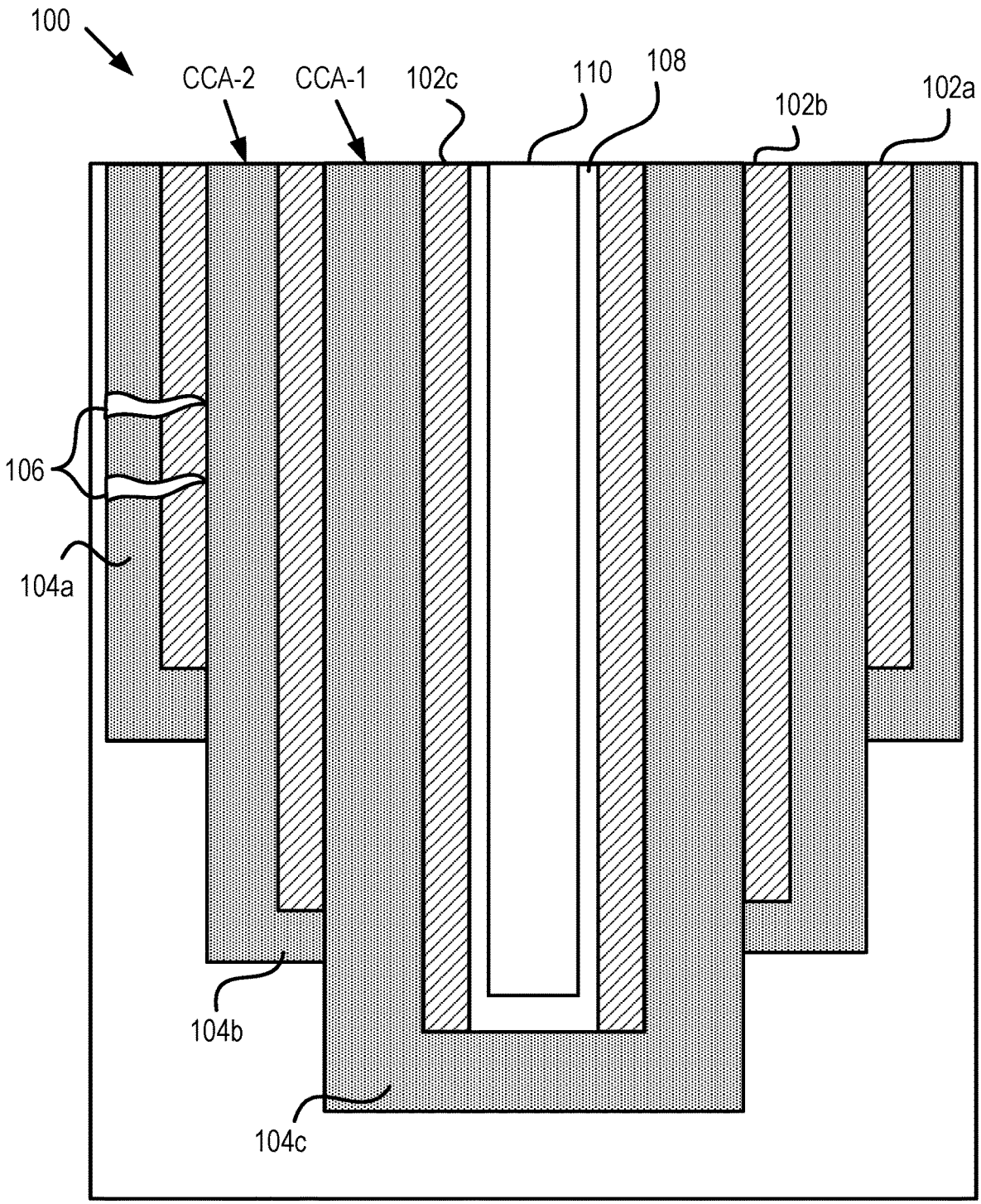
FIG. 1 is a schematic cross-sectional side view of a wellbore with sustained casing pressure within concentric casing strings, which may be repaired with systems and methods according to one or more embodiments of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to concentric casing string cement repair and, more particularly, to methods and systems for concentric casing string cement repair using laser milling tools that do not require a full drilling rig. The embodiments disclosed herein include methods and systems which utilize a laser-milled and abrasively jetted window extending through concentric casing strings and cement columns to approach a leak. The methods and systems may further involve introducing a primary plug for milling and filling operations, which may include introducing a secondary plug into the wellbore flowpath above the primary plug to fill in any leaks or failures. The secondary plug may form a gas-tight seal within and around the leaks or failures. The primary and secondary plugs may be further milled out to restore a wellbore flowpath downhole, such that further operations may continue in the wellbore once the leaks or failures are corrected. Accordingly, the methods and systems disclosed herein may enable rapid equipment deployment for the sealing of leaks causing sustained casing pressure without requiring the use of a full drilling rig. Progressive laser milling and abrasively jetted cement cleaning may enable the sealing of leaks within the outermost concentric casing strings or cement columns without requiring full workover operations.

FIG. 1 is a schematic cross-sectional side view of a wellbore 100 with sustained casing pressure behind one or more of a plurality of concentric casing strings 102*a-c* disposed within the wellbore 100, according to one or more embodiments of the present disclosure. A first casing-casing annulus CCA-1 is defined radially between casing strings 102*c* and 102*b*, and a second casing-casing annulus CCA-2 is defined between casing strings 102*a*, 102*b*. The sustained casing pressure in the illustrated embodiment may be due to a failure in a cement column 104*a* around the first casing string 102*a*. The cement column 104*a*, as shown, includes a plurality of leaks 106 which may enable flow within the cement column 104*a*. In the illustrated embodiment, the leaks 106 further penetrate through the first casing string 102*a* due to the sustained casing pressure and associated damage. In some embodiments, however, the sustained casing pressure may be caused by channels within the cement column 104*a* in fluid communication with a surface location (e.g.,) without damage to the first casing string 102*a*. To repair the leaks 106 behind (radially outward of) the first casing string 102*a*, corrective operations disclosed herein may include selective removal of a portion of second and third casing strings 102*b,c* and cement columns 104*b,c* between the wellbore flowpath 108 and the leaks 106. However, any of the cement columns 104*a-c* and any of the first, second, or third casing strings 102*a-c* may include leaks or failures that may cause sustained casing pressure within the wellbore 100. Prior to, or in concert with, a beginning of repair operations within the wellbore 100, any production tubing 110 inserted therein may be retracted out of the wellbore 100.

Example progressive steps of a repair operation will now be provided with reference to FIGS. 2 and 4-8, which depict a series of cross-sectional side views of the wellbore 100, according to one or more embodiments.

Figure 2:
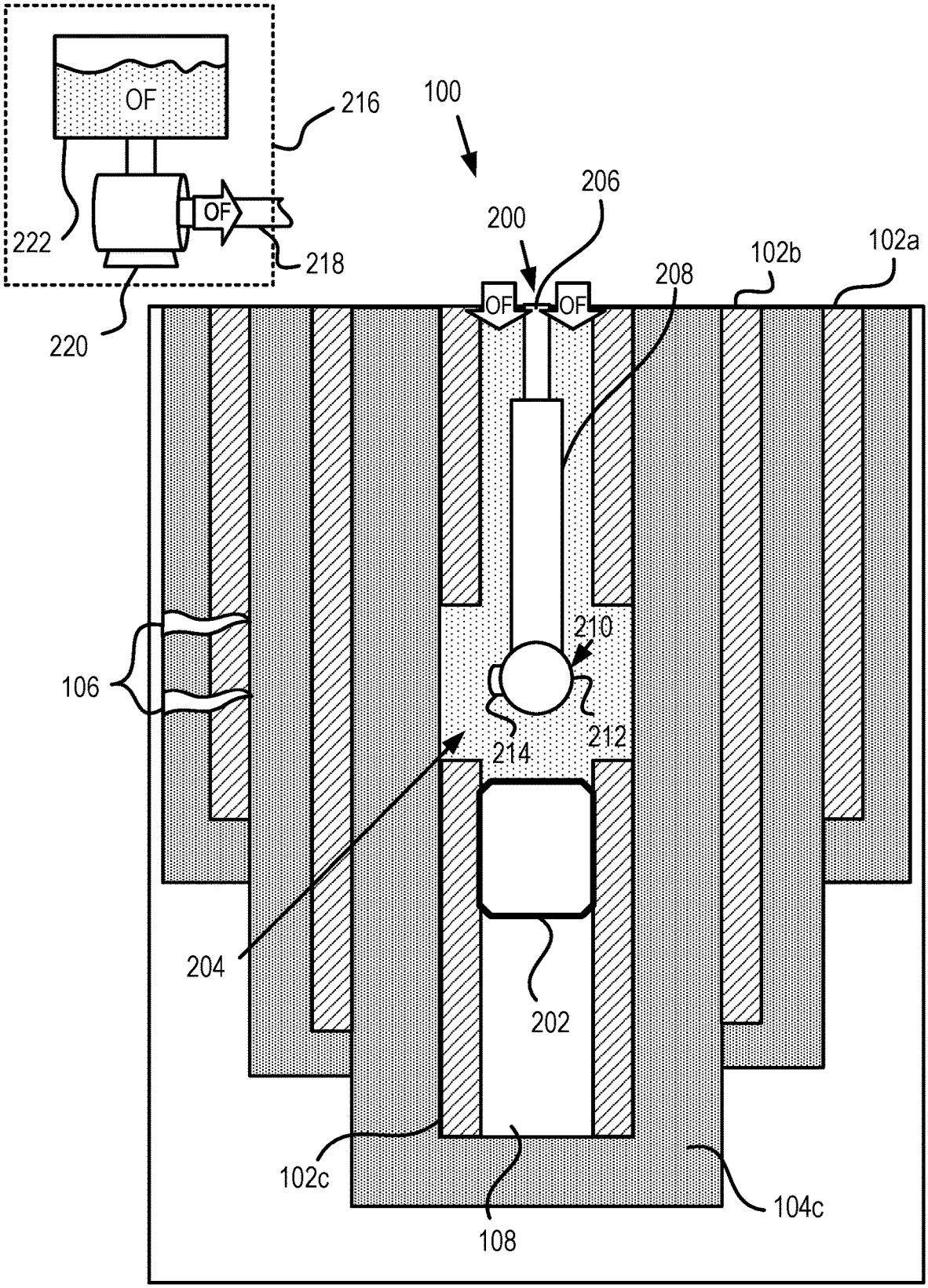
FIG. 2 is a schematic cross-sectional side view of the wellbore with production tubing removed, a primary plug installed and a laser milling tool inserted therein for progressive milling of the concentric casing strings, according to an initial step of a repair operation of one or more embodiments of the present disclosure.

FIG. 2 is a schematic cross-sectional side view of the wellbore 100 with production tubing 110 (FIG. 1) removed from the wellbore flowpath 108, and a laser milling tool 200 inserted therein according to an initial step of the repair operation of one or more embodiments of the present disclosure. The laser milling tool 200 may be inserted into the wellbore flowpath 108 following setting of a primary plug 202 within the third casing string 102*c*, which may be referred to as the radially innermost casing string. The primary plug 202 may be set within the wellbore flowpath 108 and may isolate any lower portions of the wellbore flowpath 108 from the area surrounding the leaks 106. In some embodiments, the primary plug 202 may be set a certain distance below the leaks 106 as illustrated to enable correction in the local area of the leaks 106. In other embodiments, the primary plug 202 may be set above the leaks 106 to seal leak paths extending between the leaks 106 and a surface location. In some embodiments, the primary plug 202 may be a bridge plug and may be either retrievable or drillable/millable in nature.

The laser milling tool 200 may be run downhole on coiled tubing 206 or another wellbore conveyance. The coiled tubing 206 may enable transfer of a laser beam 309 (FIG. 3) or laser energy from the surface to the laser milling tool 200 downhole. An operator at the surface may utilize a coiled tubing unit (not shown) on the surface to raise and lower the coiled tubing 206 for deploying, positioning, maneuvering, and withdrawing the laser milling tool 200 without a full drilling rig, as will be appreciated by those skilled in the art. The laser milling tool 200 may include a laser head 210 and a support structure 208 for coupling the laser head 210 to the coiled tubing 206.

The laser head 210 may include a body 212 with a nozzle 214 protruding therefrom. The body 212 may protect internal components of the laser head 210 (see FIG. 3) from the ambient environment downhole, while the nozzle 214 may provide a path for laser beam 309 (FIG. 3) to reach the third (innermost) casing string 102*c*. The laser milling tool 200 may be translated and rotated from the coiled tubing unit on the surface, or may be locally translated via motors (not shown) within the laser milling tool 200. Translation and rotation of the laser milling tool 200 and nozzle 214 may enable selective milling of the third casing string 102*c* in the illustrated pattern. Accordingly, the milling of the third casing string 102*c* in the illustrated pattern may begin formation of a window 204, in which a secondary plug 600 (FIG. 6) may later be installed as described below.

In some embodiments, the laser milling tool 200 may be operated in an environment filled with an optical fluid "OF" selected to facilitate transmitting the laser energy within the wellbore 100. In these embodiments, the optical fluid "OF" may be stored at a first external location 216 (e.g., at the surface or otherwise outside the wellbore 100). The optical fluid "OF" may be of a density to maintain well control within the wellbore 100 while possessing optical properties to enable laser emission therethrough. In some embodiments, the optical fluid "OF" may include liquids such as glycerin, glycols, or alcohols. In other embodiments the optical fluid "OF" may include gaseous fluids such as nitrogen or argon, or other inert gases. The optical fluid "OF" may be provided to the wellbore 100 via a fluid line 218 which is in further communication with a pump 220. The pump 220 may provide the optical fluid "OF" at sufficient volume and flowrate to replace any downhole fluids with the optical fluid "OF" within the area surrounding the window 204. In some embodiments, the pump 220 is in fluid communication with a reservoir 222, which may be a fluid tank, repurposed wellbore, or other fluid container for storing optical fluid "OF".

The laser milling tool 200 may be operated within the wellbore 100 until the desired window 204 has been milled from the third casing string 102*c*. In some embodiments, the laser milling tool 200 may be pulled out of hole to enable deployment of further tooling for cleaning out the cement column 104*c*. In further embodiments, however, the laser milling tool 200 may be utilized in both milling of the third casing string 102*c* and the third cement column 104*c*, without departing from the scope of this disclosure.

Figure 3:
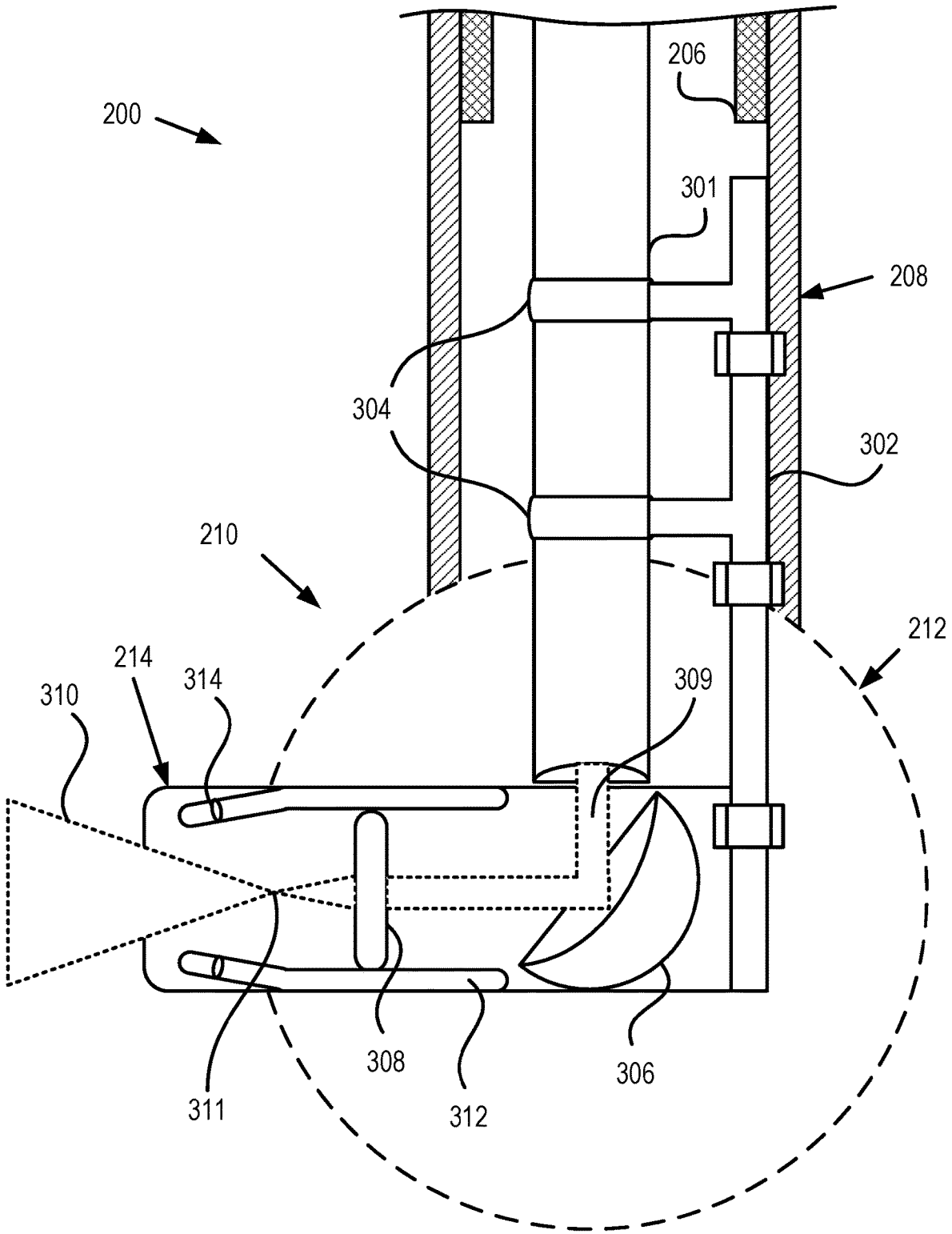
FIG. 3 is a schematic cross-sectional side view of the laser milling tool, according to one or more embodiments of the present disclosure.

FIG. 3 is a schematic cross-sectional side view of the laser milling tool 200, according to one or more embodiments of the present disclosure. As discussed above, the laser milling tool 200 be run downhole on, coiled tubing 206. The coiled tubing 206 may include an insulated fiber optic cable 301 therein for transmitting the laser beam 309 and/or laser energy downhole. The laser milling tool 200 may be fixedly coupled to the coiled tubing 206 via the support structure 208 as described above. The support structure 208 may further include a support rod 302 and a plurality of support rings 304. The support rod 302 may be fixedly coupled to the body 212 and/or nozzle 214 of the laser head 210 and may provide a structural backbone for the laser milling tool 200. The support rod 302 supports the plurality of support rings 304 at axially spaced locations along the fiber optic cable 301. The support rings 304 may be sized to receive, clamp or otherwise secure the fiber optic cable 301, such that the support rod 302 fixes an end of the fiber optic cable 301 at a desired position and orientation with respect to the laser head 210. The support structure 208 may thus transmit rotational and longitudinal motion from the coiled tubing 206 to the laser head 210 without disrupting transmission of the laser beam 309 to the laser head 210.

The nozzle 214 of the laser milling tool 200 may extend into the body 212 to receive the laser beam 309 or energy from the coiled tubing 206 and/or fiber optic cable 301. The nozzle 214 may include a reflector 306 therein for angular redirection of the laser beam 309 towards an end of the nozzle 214. The reflector 306 may include an angled mirror, beam splitter, or prism capable of aiming the laser beam 309 towards a desired target while controlling the orientation, size, and number of beams produced within the nozzle 214. Further, the nozzle 214 may include a focus lens 308 interposing an outlet end of the nozzle 214 and the reflector 306, such that the redirected laser beam 309 from the reflector 306 may be appropriately focused for milling operations on a target exterior to the nozzle 214. In the illustrated embodiment, the focus lens 308 alters the shape of the laser beam 309 to focus the laser beam 309 to a focal point 311 within the nozzle 214, such that an output defocused beam 310 may divergently exit the nozzle 214 towards a target. In other embodiments, the defocused beam 310 may be collimated with a collimator (not shown) before exiting the nozzle 214.

The focus lens 308 may be supported within the nozzle 214 via one or more lens supports 312. The one or more lens supports 312 may couple the focus lens 308 to the nozzle 214 while retaining the focus lens 308 in a particular location or orientation. In the illustrated embodiment, the lens supports 312 include a fluid knife generator 314 therein. The fluid knife generator 314 may expel air, specific gases, or optical fluids into the nozzle 214 for protecting the focused lens 308 and other internal components from debris and external fluids. The fluid knife generator 314 may expel a pressurized optical fluid within or near the nozzle 214 to isolate the nozzle 214 from the wellbore flowpath 108 and any generated debris. In some embodiments, a thin curtain of fluid may be continuously provided within the nozzle 214 to prevent further fluids or debris from entering the nozzle 214. In further embodiments, however, the fluid knife generator 314 may pump expel pressurized fluid into the nozzle 214 at a greater pressure than the wellbore environment to prevent flow into the nozzle 214. The fluid knife generator 314 may be located at or near the outlet end of the nozzle and may provide an unobstructed area within the nozzle 214 through which the defocused beam 310 may pass.

Figure 4:
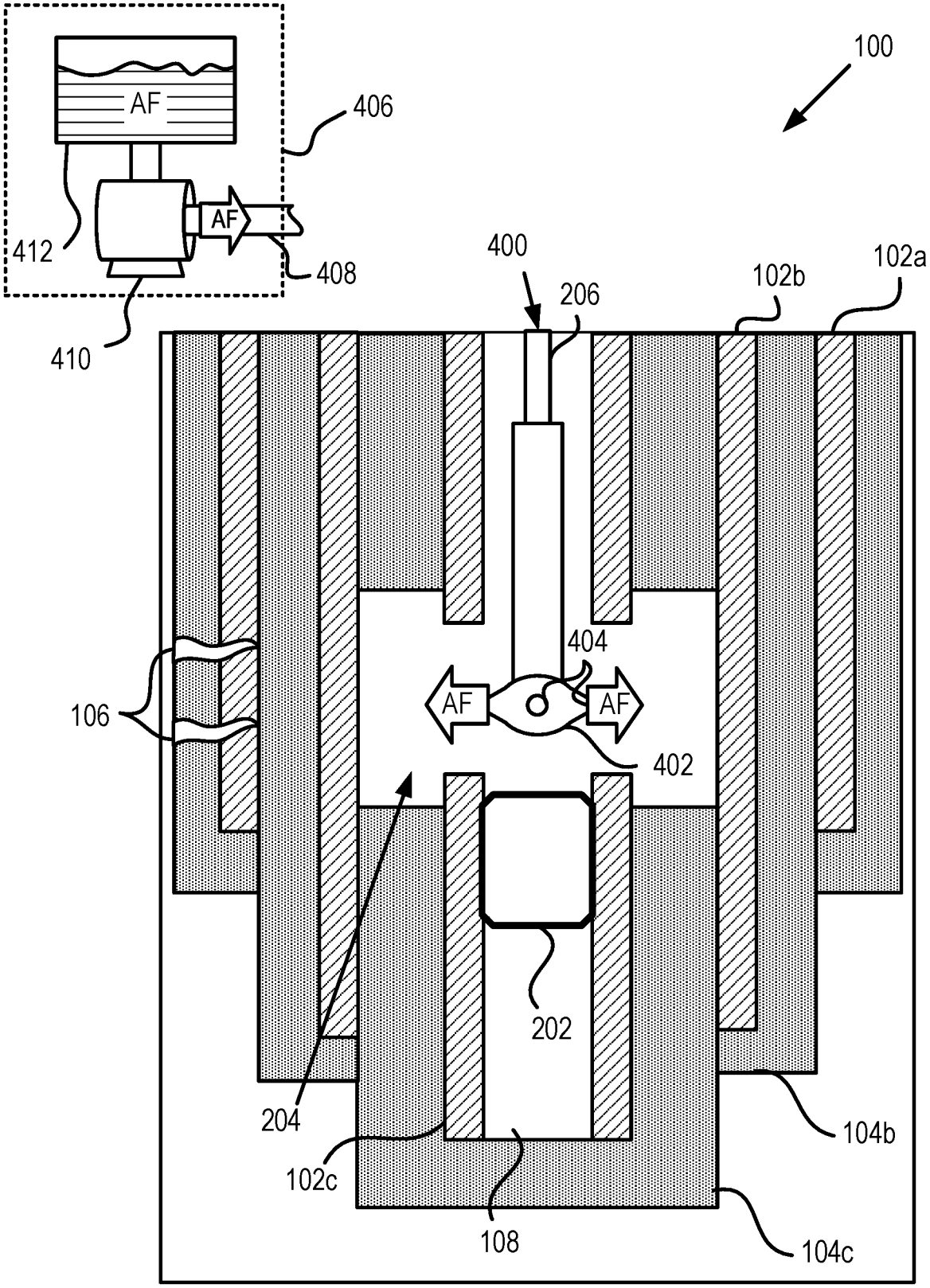
FIG. 4 is a schematic cross-sectional side view of the wellbore with an abrasive fluid injection tool inserted therein for progressive removal of cement, according to subsequent steps of the repair operation.

FIG. 4 is a schematic cross-sectional side view of the wellbore 100 with an abrasive fluid injection tool 400 inserted therein for progressive removal of cement from portions of the cement columns 104*a*, 104*b*, etc. according to subsequent steps of the repair operation. Following milling of the window 204 within the third (innermost) casing string 102*c*, the abrasive fluid injection tool 400 may be positioned within the wellbore flowpath 108 to expand the window 204 radially outward through the third cement column 104*c*. Operation of the abrasive fluid injection tool 400 may include running an injection head 402 downhole on coiled tubing 206 until the injection head 402 reaches the window 204. An abrasive fluid "AF" may be provided through the coiled tubing 206 to and injected into the window 204 via one or more injection nozzles 404 of the injection head 402. The abrasive fluid "AF" is directed towards the cement columns 104*b-c* to clean out exposed cement. The abrasive fluid "AF" may be provided to the coiled tubing 206 from a second external location 406 (external to the wellbore 100 via a fluid line 408. The fluid line 408 may be in fluid communication with a pump 410, which may provide the abrasive fluid "AF" at sufficient volume and flowrate to effectively clean out the exposed cement. In some embodiments, the pump 410 is in fluid communication with a reservoir 412, which may be a fluid tank, repurposed wellbore, or other fluid container for storing abrasive fluid "AF". In some embodiments, the abrasive fluid "AF" may be a suspension of sand within a working fluid, such as water with a thickening agent, which may be used in cement cleanout tasks. The abrasive fluid injection tool 400 may accordingly clean out the cement columns 104*b-c* until reaching an inner surface of a surrounding casing string, e.g., the second casing string 102*b* as illustrated in FIG. 4. The expansion of the window 204 via the abrasive fluid injection tool 400 may expose an inner surface of the second casing string 102*b* to enable further laser milling operations to be conducted on the second casing string 102*b* once the abrasive fluid injection tool 400 is withdrawn from the wellbore. In further embodiments, the abrasive fluid injection tool 400 may include one or more scrapers (not shown) with blades or brushes formed of steel to mechanically remove the cement columns 104*b-c*.

Further operations of the laser milling tool 200 and abrasive fluid injection tool 400 may be performed as needed to further radially expand the window 204 and thereby reach the location of the leaks 106. In some embodiments, new optical fluid "OF", or a further cleaning fluid, may be pumped downhole after milling and cement cleanout (abrasive jetting) operations to remove any debris and dust from the previous operations. In the illustrated embodiment, the leaks 106 are located within the first cement column 104*a* and the first casing string 102*a*, and the illustrated operations may be performed until exposing the first casing string 102*a* through the second cement column 104*b*. While three concentric casing strings 102*a-c* are illustrated here, the laser milling tool 200 and abrasive fluid injection tool 400 may be deployed through any number of casing strings 102*a-c* without departing from the scope of this disclosure. In some embodiments, the third casing string 102*c* may be a radially innermost casing string, while the second casing string 102*b* may be a radially outward casing string circumscribing the radially innermost casing string, agnostic of the number of casing strings 102*a-c* present within the wellbore 100. In the illustrated embodiment, the laser milling and abrasive jetting operations may been performed up until the window 204 is in fluid communication with the leaks 106 (see FIG. 5).

Figure 5:
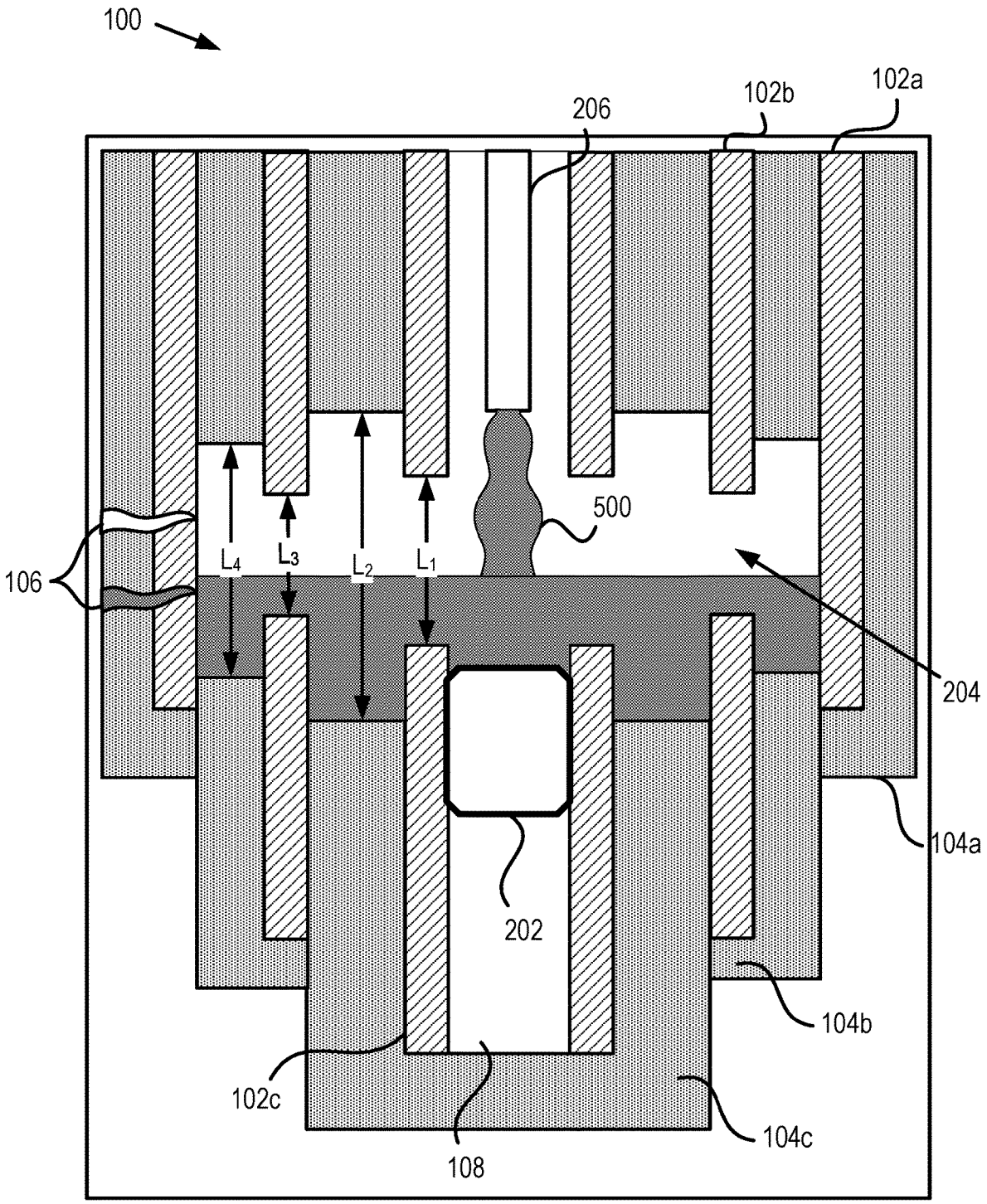
FIG. 5 is a schematic cross-sectional side view of the wellbore with a completed window partially filled with a secondary plug material, according to subsequent steps of the repair operation.

FIG. 5 is a schematic cross-sectional side view of the wellbore 100 with a completed window 204 partially filled with a secondary plug material 500, according to subsequent steps of the repair operation. Following the laser milling and abrasive jetting operations discussed above, coiled tubing 206 may be inserted into the wellbore flowpath 108 above the window 204. The coiled tubing 206 may deliver the secondary plug material 500 into the window 204 to create a secondary plug 600 (FIG. 6) above the primary plug 202. The secondary plug material 500 may include a resin mixture, a cement mixture, a molten eutectic alloy, a solid eutectic alloy to be melted downhole, or a combination thereof. The secondary plug material 500 may fill the window 204 and may seep into the leaks 106 present therein, such that the leaks 106 may be plugged.

In the illustrated embodiment, the window 204 defines a plurality of axial lengths $L_1$-$L_4$ are shown within the window 204. The plurality of lengths $L_1$-$L_4$ may be generated via the laser milling operations and abrasive jetting operations of FIGS. 2 and 4. As shown in the illustrated embodiment, the length $L_2$ of the cleaned out cement from the third cement column 104*c* may be greater than the length $L_1$ removed from the third casing string 102*c*. The laser milling operations of FIG. 2 may be utilized in generating the length $L_1$ within the third casing string 102*c*, while the abrasive jetting operations of FIG. 4 may be utilized in generating the length $L_2$ within the third cement column 104*c* up and behind the third casing string 102*c*. Further, the length $L_3$ removed from the second casing string 102*b* may be less than length $L_1$ removed from the third casing string 102*c*. Similarly, the length $L_4$ removed from the second cement column 104*b* may be less than length $L_2$ removed from the third cement column 102*b*. The stepped nature of the removed casing strings 102*a-c* and cement columns 104*a-c* may enable enhanced sealing with the secondary plug material 500 within the window 204. The exposed casing strings 102*a-c* may be bonded to the secondary plug material 500, such that the secondary plug material 500 may be held in place even following drilling or milling of the secondary plug material 500 (see FIG. 7).

Figure 6:
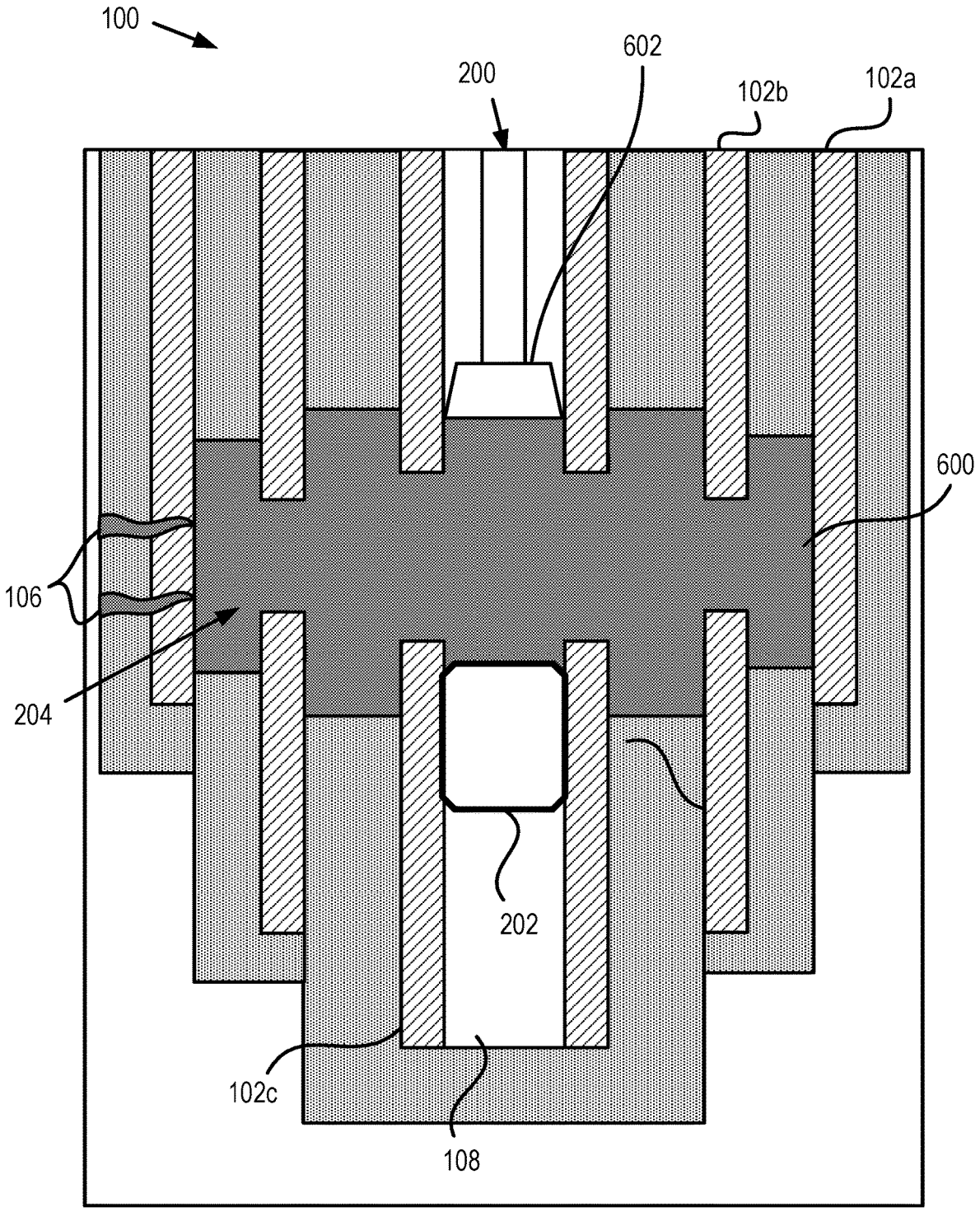
FIG. 6 is a schematic cross-sectional side view of the wellbore with a solidified secondary plug, according to subsequent steps of the repair operation.

FIG. 6 is a schematic cross-sectional side view of the wellbore 100 with a solidified secondary plug 600, according to subsequent steps of the repair operation. As shown in the illustrated embodiment, the secondary plug material 500 (FIG. 5) has hardened into a solidified secondary plug 600 which has expanded to fill the window 204, any micro-annuli forming leak paths, the leaks 106, and the wellbore flowpath 108 above the primary plug 202. Depending upon the type of secondary plug material 500 introduced into the window 204, a squeezing tool 602 may be utilized in setting the solidified secondary plug 600. The squeezing tool 602 may be pressed down upon the secondary plug material 500 during solidification to aid in maintaining a shape and penetration of the secondary plug material 500 into the leaks 106.

The solidified secondary plug 600 may form a gas-tight seal within any voids present in the wellbore 100 above the primary plug 202. In some embodiments, the solidified secondary plug 600 may bond to the casing strings 102*a-c* at exposed surfaces within the axial lengths $L_1$-$L_4$ (FIG. 5) of the window 204. In these embodiments, a seal may be created within the wellbore 100, such that a quality gas-tight seal is present between the casing strings 102*a-c* and the solidified secondary plug 600. Accordingly, any leaks 106 or other failures may be filled or plugged, such that any sustained casing pressure issues may be remediated. In some embodiments, the secondary plug material 500 includes a eutectic alloy that may expand during solidification, and may provide an additional benefit of generating a metal-to-metal seal with the casing strings 102*a-c* for further sealing and reliability.

Figure 7:
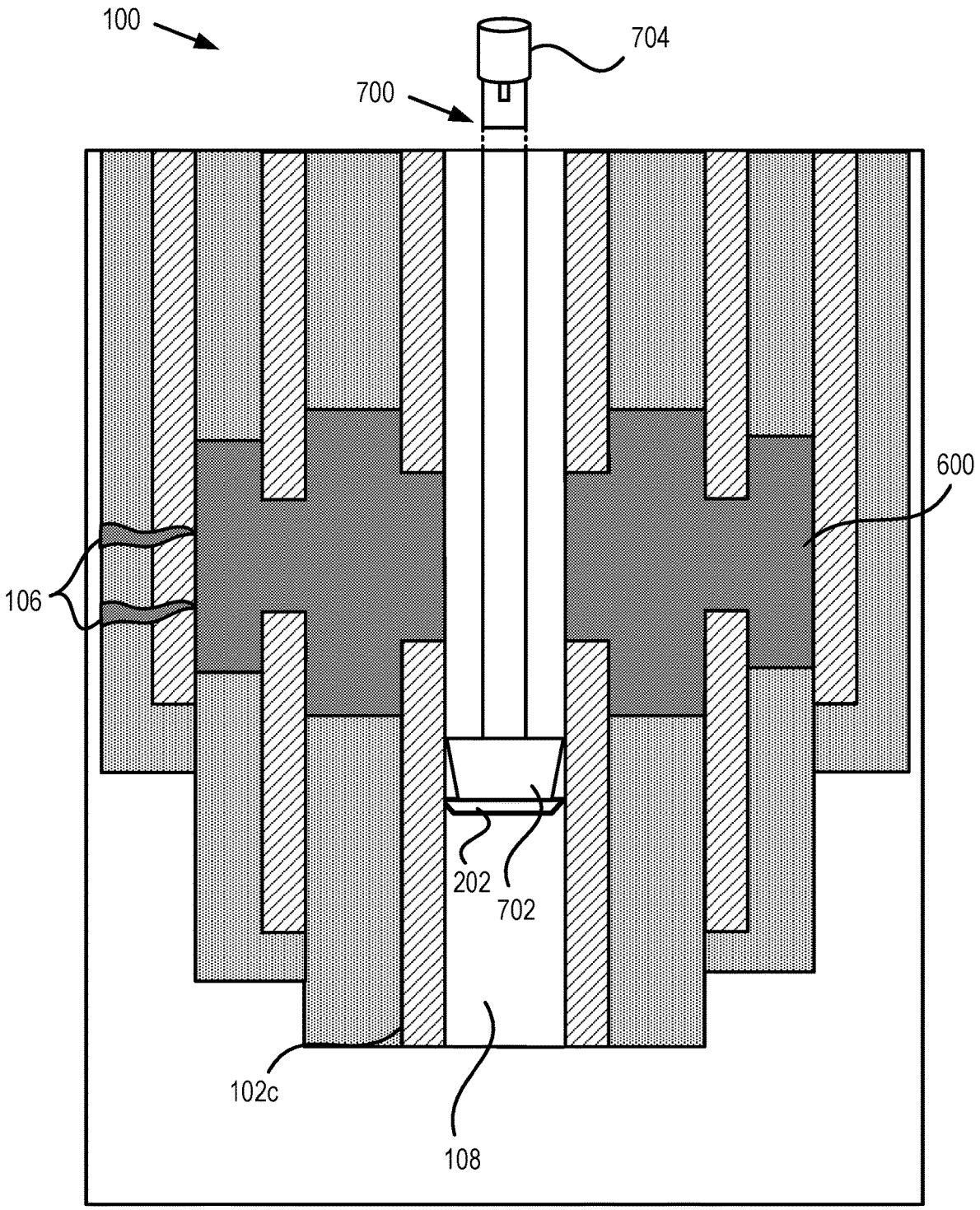
FIG. 7 is a schematic cross-sectional side view of the wellbore with a drill string inserted therein for drilling through the primary and secondary plug, according to subsequent steps of the repair operation.

FIG. 7 is a schematic cross-sectional side view of the wellbore 100 with a drill string 700 inserted within the wellbore flowpath 108, according to one or more embodiments of the present disclosure. The drill string 700 may include a drill bit 702 therein that is chosen to drill through the solidified secondary plug 600, whether that is cement, resin, or metallic alloy. In some embodiments, the drill bit 702 may be a milling element for milling through the solidified secondary plug 600. The drill string 700 may be advanced within the wellbore flowpath 108 until the drill bit 702 reaches the solidified secondary plug 600. The drill string 700 may be in communication with an external hydraulic motor 704 configured to provide a desired motion to the drill bit 702 without the use of a full drilling rig.

As shown in the illustrated embodiment, the drill bit 702 may then be utilized in drilling out the wellbore flowpath 108 through both the solidified secondary plug 600 and the primary plug 202. In some embodiments, the primary plug 202 may be a retrievable bridge plug set within the wellbore flowpath 108. In these embodiments, the drill bit 702 may drill out the solidified secondary plug 600 up to the primary plug 202, at which point the primary plug 202 may be unset and retracted out of the wellbore 100. Regardless of the type of primary plug 202 utilized, the wellbore flowpath 108 may be restored through the repaired area to enable further use of the wellbore 100. The drill bit 702 may be chosen to match the diameter of the third casing string 102*c*, such that the wellbore flowpath 108 may remain constantly sized throughout the wellbore 100.

Figure 8:
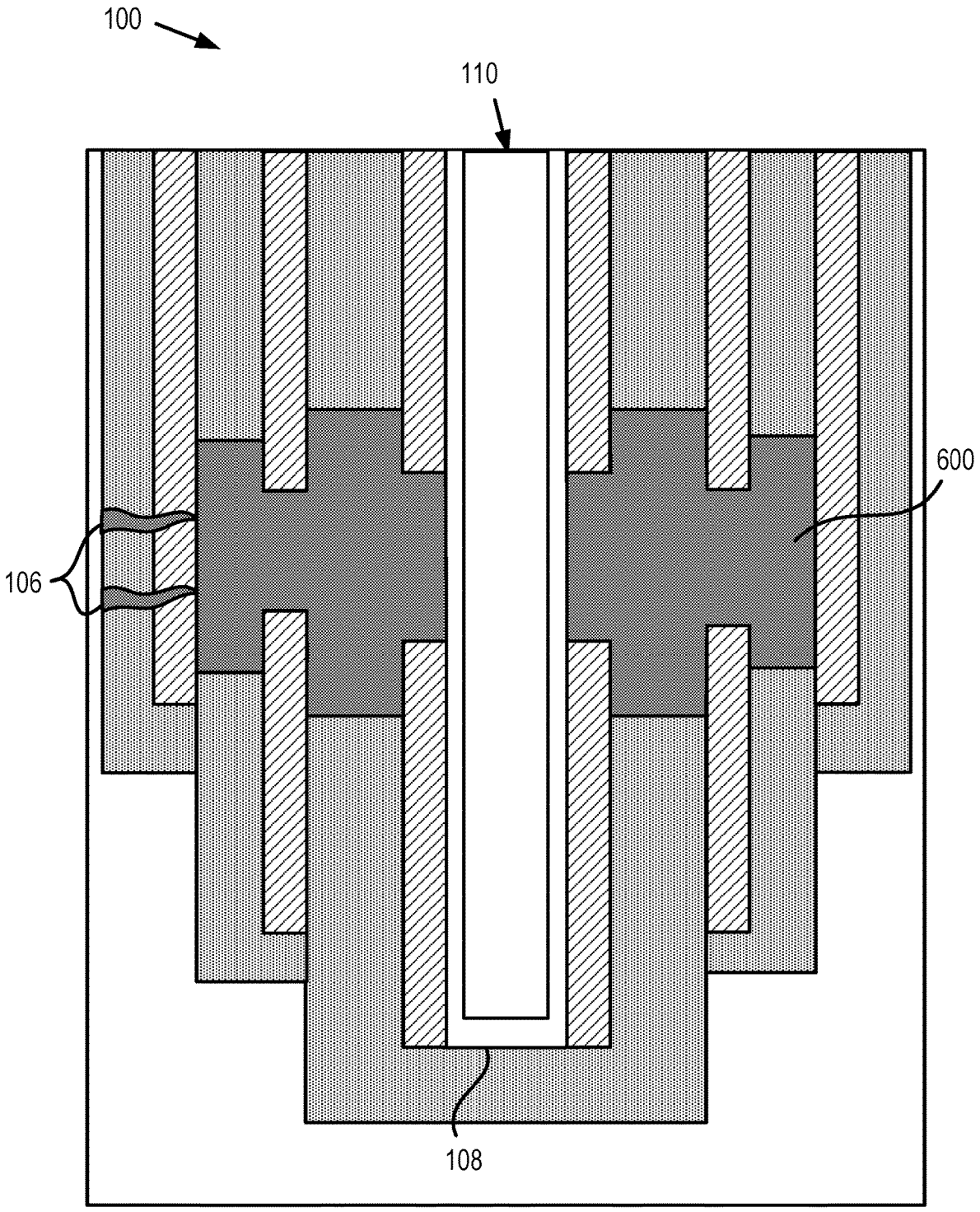
FIG. 8 is a schematic cross-sectional side view of the wellbore with production tubing reinstalled, according to subsequent steps of the repair operation.

FIG. 8 is a schematic cross-sectional side view of the wellbore 100 with the production tubing 110 reinstalled, according to one or more embodiments of the present disclosure. The production tubing 110 may be reinstalled within the wellbore flowpath 108 through the solidified secondary plug 600 after drilling. The remaining portions of the solidified secondary plug 600 may maintain a seal within the leaks 106, such that the sustained casing pressure may be alleviated or removed. The production tubing 110 may then be reutilized in hydrocarbon production operations within the wellbore 100 without sustained casing pressure.

Through the progressive utilization of the laser milling system as shown in FIGS. 2 and 4-8, the sustained casing pressure may be remediated within the concentric casing strings 102*a-c* and cement columns 104*a-c*. The laser milling system may include, but is not limited to, the primary plug 202, the laser milling tool 200, the abrasive fluid injection tool 400, the solidified secondary plug 600, the drill string 700, and any components thereof that are utilized in the embodiments illustrated herein.

Figure 9:
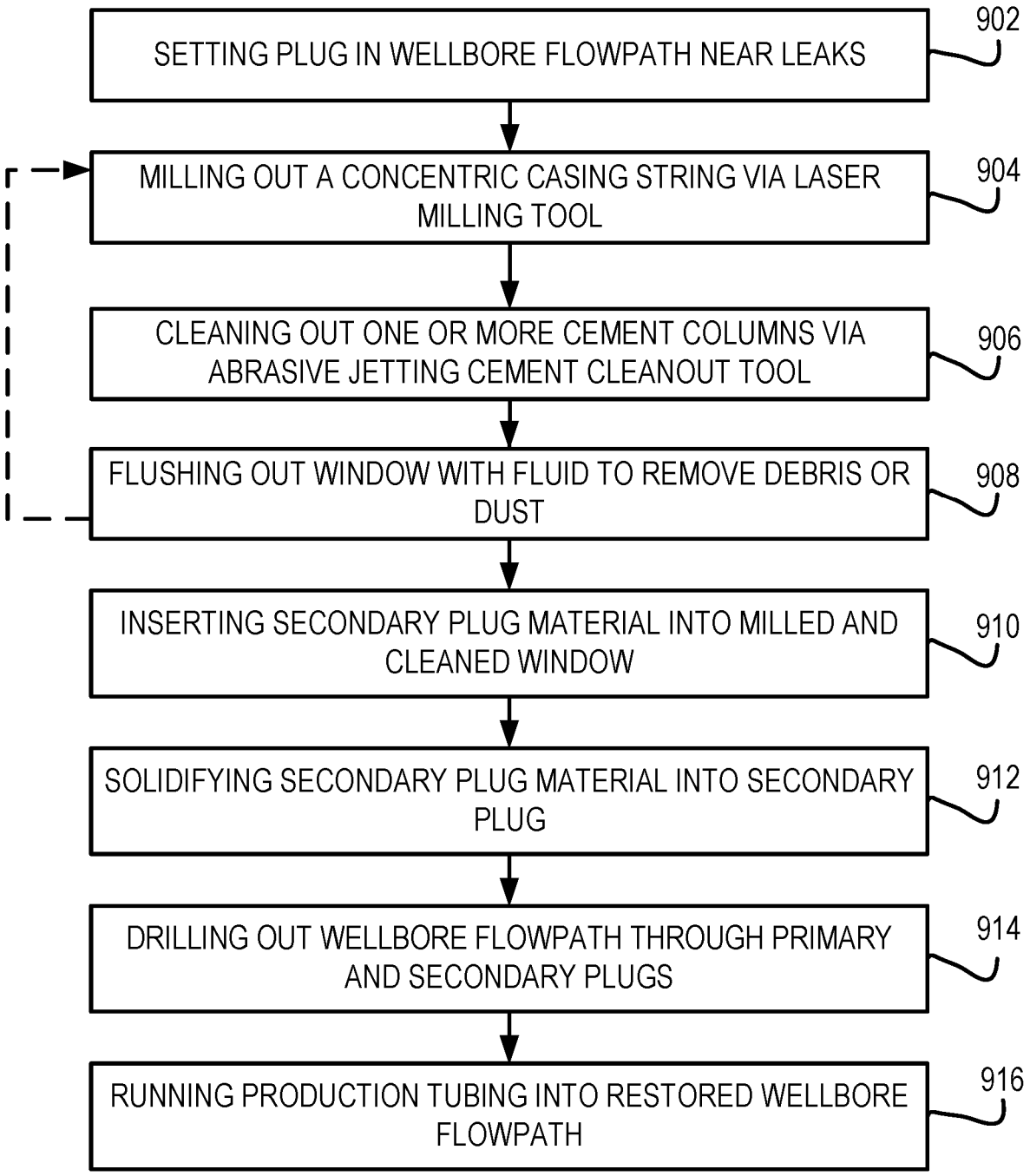
FIG. 9 is a schematic flowchart of an example method for correcting a leak within concentric casing strings via a laser milling system.

FIG. 9 is a schematic flowchart of an example method 900 for correcting a leak (e.g., the leaks 106) within concentric casing strings (e.g., concentric casing strings 102*a-c*) via a laser milling system. The method 900 may include setting a primary plug (e.g., the primary plug 202) within the wellbore flowpath (e.g., the wellbore flowpath 108) near, above or below the location of the leaks at 902. The setting of the primary plug at 902 may enable further repair processes to be performed within the wellbore (e.g., the wellbore 100) near the leaks without affecting the remainder of the wellbore flowpath. The primary plug may be a drillable plug which may be drilled out at a later time, or may be an expandable, retrievable plug which may be collapsed and retracted out of hole following repairs.

The method 900 may include laser milling out a portion of a concentric casing string via a laser milling tool (e.g., the laser milling tool 200) at 904. The laser milling of the concentric casing string may create a window (e.g., the window 204) within the concentric casing string. In some embodiments, the laser milling tool may be run downhole on coiled tubing (e.g., the coiled tubing 206) such the method 900 may be completed without a drilling rig. The window milled out at 904 may enable access to one or more cement columns (e.g., the one or more cement columns 104*a-c*) within the wellbore flowpath.

The method 900 may further include cleaning out one or more cement columns behind the concentric casing string at 906 via an abrasive jetting tool (e.g., the abrasive fluid injection tool 400). The abrasive jetting tool may be deployable within the wellbore flowpath to expand the window through one or more cement columns to provide access to the leaks or another concentric casing string for further operations. In some embodiments, the abrasive jetting tool may be run downhole on coiled tubing such that a drilling rig may not be required for completing the method 900. In some embodiments, three or more concentric casing strings may be installed within the wellbore. In these embodiments, based on the locations of the leaks, the laser milling at 904 and abrasive jetting cement cleaning at 906 may be repeated in progressive operations until the leaks are in fluid communication with the window and wellbore flowpath. In some embodiments, the laser milling at 904 may continue into the cement columns, such that the cement is milled out via the laser milling tool. In these embodiments, the abrasive jetting tool may remove any remaining cement in the milled area. In some embodiments, the abrasive jetting tool may further include one or more steel blades or brushes to aid in cleaning out the cement columns.

The method may further include flushing out the window with a clean fluid (e.g., the optical fluid "OF") to remove any further debris or dust at 908. The clean fluid may circulate within the window and may carry out any contaminants, such as the debris or dust, to enable further operations in a clean environment. The flushing of the window at 908 may be performed any number of times between downhole operations as subsequent millings or cement cleanouts are performed. In some embodiments, cleaning out the cement columns may expose interior surfaces of one or more concentric casing strings. In these embodiments, the abrasive jetting operations at 906 may expand the window of cleaned cement behind the concentric casing string to a length greater than that of the window through the concentric casing string.

The method 900 may further include inserting a secondary plug material (e.g., the secondary plug material 500) into the milled and cleaned out window at 910. The secondary plug material may include a resinous material, a cement material, or a eutectic alloy for formation of a secondary plug within the wellbore flowpath. The secondary plug material may form a bond with the exposed cement columns and/or concentric casing strings to generate a seal within the window and wellbore flowpath. The method 900 may continue at 912 with solidifying the secondary plug material into a solidified secondary plug (e.g., the solidified secondary plug 600). The solidification of the secondary plug may be facilitated through a squeezing tool (e.g., the squeezing tool 602) for resins or cements, or may be completed through melting and cooling of a eutectic alloy. The solidified secondary plug may penetrate the leaks within the wellbore and may generate a gas-tight seal within the wellbore flowpath to repair the cement columns and casing strings.

The method 900 may further include drilling out the wellbore flowpath through the solidified secondary plug at 914 via a drill string (e.g., the drill string 700). The drill string may include a drill bit (e.g., the drill bit 702) installed thereon for drilling out of the solidified eutectic plug in the same diameter as the wellbore flowpath. In some embodiments, the drill string 700 may be powered by a hydraulic motor (e.g., the external hydraulic motor 704) such that a drilling rig may not be necessary to complete the method 900. In some embodiments, the drilling out of the wellbore flowpath at 914 may include drilling through the plug previously set at 902. In further embodiments, however, the method 900 can include unsetting the plug and retracting the plug out of hole at 916 for embodiments utilizing expandable, retrievable plugs.

The method 900 may further include running production tubing (e.g., the production tubing 110) within the wellbore flowpath including the leak remediation therein at 916. The running of production tubing 110 may enable further wellbore operations within the wellbore without sustained casing pressure, such that normal operations of the wellbore may continue.

Embodiments disclosed herein include:

A. A method comprising setting a primary plug within a wellbore flowpath defined through a radially innermost casing string of a plurality of concentric casing strings, operating a laser milling tool within the wellbore flowpath to discharge a laser beam into the wellbore flowpath to thereby mill a window through the radially innermost casing string and radially outward towards a radially innermost cement column of a plurality of respective cement columns surrounding each of the concentric casing strings, discharging an abrasive fluid from an abrasive jetting tool into the wellbore flowpath and thereby cleaning out the radially innermost cement column to expand the window radially, flowing a secondary plug material into the window and the wellbore flowpath above the primary plug, solidifying the secondary plug material to form a solidified secondary plug within the window, and drilling out the solidified secondary plug to restore the wellbore flowpath through the solidified secondary plug.

B. A wellbore repair system comprising a plurality of concentric casing strings disposed within a wellbore, a plurality of cement columns disposed radially outward of each of the concentric casing strings, a window defined radially through at least a radially innermost casing string of the one or more of the concentric casing strings and a radially innermost cement column of the plurality of cement columns, wherein the window defines a first axial length through the radially innermost casing string and a second axial length through the radially innermost cement column, and wherein the second axial length is greater than the first axial length, a primary plug set within an interior of the radially innermost casing string below the window, and a solidified secondary plug filling the window above the primary plug.

C. A wellbore system comprising a plurality of concentric casing strings disposed within a wellbore, a plurality of cement columns disposed radially outward of each of the concentric casing strings, a primary plug set within an interior of a radially innermost casing string of the plurality of concentric casing strings, a laser milled window defined in the radially innermost casing string and defining a first axial length, an abrasive jetting tool including a jetting head and one or more nozzles, couplable to the coiled tubing, and insertable within the flowpath of the wellbore to clean out cement from the radially innermost cement column to a second axial length greater than the first axial length by jetting an abrasive fluid behind the radially innermost casing string through the laser milled window, and a secondary plug material insertable into the window to generate a solidified secondary plug Each of embodiments A through C may have one or more of the following additional elements in any combination: Element 1: further comprising: drilling into the primary plug subsequent to drilling out the solidified secondary plug to restore the wellbore flowpath, wherein the primary plug is a drillable plug. Element 2: further comprising: releasing the primary plug from below the drilled solidified secondary plug; and retracting the primary plug from the wellbore flowpath, wherein the primary plug is an expandable, releasable plug. Element 3: further comprising: running a production tubing through the solidified secondary plug subsequent to restoring the wellbore flowpath therethrough. Element 4: further comprising: pumping an optical fluid into the wellbore flowpath; and transmitting the laser beam through the optical fluid. Element 5: wherein the window extends through the radially innermost string at a first axial length, and wherein cleaning out the radially innermost cement column axially extends the window through the radially innermost cement column to a second axial length that is greater than the first axial length. Element 6: further comprising: milling through a radially outward casing string of the plurality of casing strings circumscribing the radially innermost casing string to expand the window radially outwardly through the radial outward casing string. Element 7: wherein milling through the radially outward casing string axially extends the window to a third length shorter than that of the first length and the second length. Element 8: further comprising: cleaning out the respective cement column surrounding the radially innermost casing string to further expand the window radially outwardly. Element 9: wherein operating the laser milling tool further includes: expelling a pressurized optical fluid within or near an outlet of the laser beam and thereby isolating the outlet of the laser beam from the wellbore flowpath and debris.

Element 10: wherein the window is further defined radially through a casing string radially outward of the radially innermost casing string to a third axial length and through a cement column radially outward of the radially innermost cement column to a fourth axial length. Element 11: wherein the second axial length is greater than that of the third axial length and the fourth axial length, and wherein the first axial length is greater than that of the third axial length. Element 12: further comprising a window defined radially through at least the radially innermost casing string to a first axial length. Element 13: wherein the window is further defined through the radially innermost cement column to a second axial length, and wherein the second axial length is greater than the first axial length. Element 14: wherein the laser milling tool further includes: a reflector within the nozzle and oriented to redirect a laser beam from the coiled tubing towards an outlet end of the nozzle; and a focus lens interposing the outlet end of the nozzle and the reflector, and operable to focus the laser beam through the outlet end of the nozzle. Element 15: further comprising: a fluid reservoir stored at an external location; a pump in fluid communication with the fluid reservoir; and a fluid line in fluid communication with the fluid reservoir and the coiled tubing or the flowpath of the wellbore, wherein the fluid reservoir stores fluid for use in laser milling or abrasive jetting operations. Element 16: wherein the fluid is an optical fluid for flushing of the wellbore and transmission of a laser beam therethrough. Element 17: wherein the fluid is an abrasive fluid for cleaning out cement via the abrasive jetting tool.

By way of non-limiting example, exemplary combinations applicable to A through C include: Element 5 with Element 6; Element 5 with Element 7; Element 5 with Element 8; Element 10 with Element 11; Element 12 with Element 13; Element 15 with Element 16; Element 15 with Element 17.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A method comprising:

setting a primary plug within a wellbore flowpath defined through a radially innermost casing string of a plurality of concentric casing strings;

operating a laser milling tool within the wellbore flowpath to discharge a laser beam into the wellbore flowpath to thereby mill a window through the radially innermost casing string and radially outward towards a radially innermost cement column of a plurality of respective cement columns surrounding each of the concentric casing strings;

discharging an abrasive fluid from an abrasive jetting tool into the wellbore flowpath and thereby cleaning out the radially innermost cement column to expand the window radially;

flowing a secondary plug material into the window and the wellbore flowpath above the primary plug;

solidifying the secondary plug material to form a solidified secondary plug within the window; and drilling out the solidified secondary plug to restore the wellbore flowpath through the solidified secondary plug.

2. The method of claim 1, further comprising:

drilling into the primary plug subsequent to drilling out the solidified secondary plug to restore the wellbore flowpath, wherein the primary plug is a drillable plug.

3. The method of claim 1, further comprising:

releasing the primary plug from below the drilled solidified secondary plug; and retracting the primary plug from the wellbore flowpath, wherein the primary plug is an expandable, releasable plug.

4. The method of claim 1, further comprising:

running a production tubing through the solidified secondary plug subsequent to restoring the wellbore flowpath therethrough.

5. The method of claim 1, further comprising:

pumping an optical fluid into the wellbore flowpath; and transmitting the laser beam through the optical fluid.

6. The method of claim 1, wherein the window extends through the radially innermost string at a first axial length, and wherein cleaning out the radially innermost cement column axially extends the window through the radially innermost cement column to a second axial length that is greater than the first axial length.

7. The method of claim 6, further comprising:

milling through a radially outward casing string of the plurality of casing strings circumscribing the radially innermost casing string to expand the window radially outwardly through the radial outward casing string.

8. The method of claim 7, wherein milling through the radially outward casing string axially extends the window to a third length shorter than that of the first length and the second length.

9. The method of claim 7, further comprising:

cleaning out the respective cement column surrounding the radially innermost casing string to further expand the window radially outwardly.

10. The method of claim 1, wherein operating the laser milling tool further includes:

expelling a pressurized optical fluid within or near an outlet of the laser beam and thereby isolating the outlet of the laser beam from the wellbore flowpath and debris.

11. A wellbore system, comprising:

a plurality of concentric casing strings disposed within a wellbore;

a plurality of cement columns disposed radially outward of each of the concentric casing strings;

a primary plug set within an interior of a radially innermost casing string of the plurality of concentric casing strings;

a laser milled window defined in the radially innermost casing string and defining a first axial length;

an abrasive jetting tool including a jetting head and one or more nozzles, couplable to the coiled tubing, and insertable within the flowpath of the wellbore to clean out cement from the radially innermost cement column to a second axial length greater than the first axial length by jetting an abrasive fluid behind the radially innermost casing string through the laser milled window; and a secondary plug material insertable into the window to generate a solidified secondary plug.

12. The wellbore system of claim 11, further comprising a window defined radially through at least the radially innermost casing string to a first axial length.

13. The wellbore system of claim 12, wherein the window is further defined through the radially innermost cement column to a second axial length, and wherein the second axial length is greater than the first axial length.

14. The wellbore system of claim 11, wherein the laser milling tool further includes:

a reflector within the nozzle and oriented to redirect a laser beam from the coiled tubing towards an outlet end of the nozzle; and a focus lens interposing the outlet end of the nozzle and the reflector, and operable to focus the laser beam through the outlet end of the nozzle.

15. The wellbore system of claim 11, further comprising:

a fluid reservoir stored at an external location;

a pump in fluid communication with the fluid reservoir; and a fluid line in fluid communication with the fluid reservoir and the coiled tubing or the flowpath of the wellbore, wherein the fluid reservoir stores fluid for use in laser milling or abrasive jetting operations.

16. The wellbore system of claim 15, wherein the fluid is an optical fluid for flushing of the wellbore and transmission of a laser beam therethrough.

17. The wellbore system of claim 15, wherein the fluid is an abrasive fluid for cleaning out cement via the abrasive jetting tool.

* * * * *